US008381932B2

(12) United States Patent
Wagner

(10) Patent No.: US 8,381,932 B2
(45) **Date of Patent: *Feb. 26, 2013**

(54) STORAGE SYSTEM

(76) Inventor: Paul Wagner, Marina Del Ray, CA (US)

( * ) Notice: Subject to any disclaimer, the term of this patent is extended or adjusted under 35 U.S.C. 154(b) by 824 days.

This patent is subject to a terminal disclaimer.

(21) Appl. No.: 12/492,591

(22) Filed: Jun. 26, 2009

(65) Prior Publication Data

US 2009/0261096 A1 Oct. 22, 2009

Related U.S. Application Data

(63) Continuation-in-part of application No. 11/823,530, filed on Jun. 28, 2007, now Pat. No. 7,988,005, and a continuation-in-part of application No. PCT/US2008/068554, filed on Jun. 27, 2008.

(51) Int. Cl.
*B65D 21/02* (2006.01)

(52) U.S. Cl. ..... 220/23.88; 220/23.83; 220/23.87; 220/500; 220/4.26; 206/430; 206/431; 206/509

(58) Field of Classification Search ..... 220/4.26, 220/23.83, 23.87, 23.88, 500; 206/430, 431, 206/509

See application file for complete search history.

(56) References Cited

U.S. PATENT DOCUMENTS

| | | | | |
|---|---|---|---|---|
| 2,740,546 | A | 4/1956 | Kowalski | |
| 3,385,465 | A | 5/1968 | Bliss | |
| 3,426,500 | A * | 2/1969 | Rupert | 53/471 |
| 3,709,235 | A | 1/1973 | Washburn et al. | |
| 4,165,812 | A | 8/1979 | Jennison | |
| 4,194,619 | A | 3/1980 | Schleny | |
| D279,621 | S | 7/1985 | Richer | |
| D281,824 | S | 12/1985 | Field | |
| 4,646,628 | A | 3/1987 | Lederman | |
| 4,911,295 | A | 3/1990 | Venegoni | |
| 5,271,520 | A | 12/1993 | McAfee | |
| 5,386,922 | A | 2/1995 | Jordan | |
| 5,392,901 | A | 2/1995 | Kuray et al. | |
| D364,248 | S | 11/1995 | Su | |
| 5,547,098 | A * | 8/1996 | Jordan | 220/23.86 |
| 5,566,824 | A | 10/1996 | Tack et al. | |
| 5,746,346 | A | 5/1998 | Crilly | |
| D396,749 | S | 8/1998 | Ortiz | |
| D415,023 | S | 10/1999 | Snyder | |
| D426,925 | S | 6/2000 | Axhamre | |
| 6,209,725 | B1 | 4/2001 | Chen | |
| 6,983,862 | B2 * | 1/2006 | Nottingham et al. | 222/109 |
| 7,090,072 | B1 | 8/2006 | Elliott | |
| 2004/0238550 | A1 | 12/2004 | Stefandl | |

FOREIGN PATENT DOCUMENTS

| | | |
|---|---|---|
| JP | 9094175 | 4/1997 |

OTHER PUBLICATIONS

PCT Search Report; PCT/US2008/068554; Oct. 27, 2008, 10 pages.
EPO Extended Search Report for PCT/US2008068554, Applicant: Paul Wagner, Form EPO/1507S, dated Mar. 8, 2012 (4 pages).

* cited by examiner

*Primary Examiner* — Anthony Stashick
*Assistant Examiner* — Elizabeth Volz

(57) ABSTRACT

A storage system for storing a plurality of fluids or other goods has a plurality of containers adapted to fit within a receptacle. Each of the containers has an inner sidewall, an outer sidewall, and a top sidewall having a spout sealable with a cap such that the container contains the fluid or other goods when the cap is engaged with the spout. The plurality of containers are shaped such that the containers are stackable or nestable within the receptacle such that the containers tessellate, the inner sidewalls of the containers abutting each other, and the outer sidewalls abutting the inner surface of the receptacle, filling substantially all of the receptacle.

20 Claims, 3 Drawing Sheets

STORAGE SYSTEM

REFERENCE TO RELATED APPLICATIONS

This application is a continuation-in-part of copending application Ser. No. 11/823,530, filed Jun. 28, 2007, entitled "STORAGE SYSTEM" and a continuation-in-part of copending International Application serial No. PCT/US2008/068554 with an international filing date of Jun. 27, 2008, entitled "STORAGE SYSTEM". The aforementioned application(s) are hereby incorporated herein by reference.

BACKGROUND OF THE INVENTION

1. Field of the Invention

This invention relates generally to storage containers, and more particularly to a storage system for storing a plurality of fluids, products, or other goods.

2. Description of Related Art

The prior art teaches various forms of containers having removable sub-containers. For example, Kowalski, U.S. Pat. No. 2,740,546, teaches a bucket having removable compartments. The compartments of the Kowalski container, however, have a round circumference and are positioned within a round bucket, thereby wasting a large portion of the volume of the bucket. Furthermore, since the containers do not abut each other in a secure manner, specially designed connectors are required. Another drawback, the Kowalski device does not include secure handles on the container, thereby making grasping, removing, and otherwise holding and/or manipulating the containers more difficult. Finally, the Kowalski device does not include the various other elements of the present invention that add to the utility of the present system.

Another prior art reference that discloses a related receptacle system is Axhamre, U.S. Pat. No. D426,925. The Axhamre receptacle also uses a paint bucket, and includes various sub-containers. The sub-containers used in Axhamre, however, are open at the top, and therefore cannot be used to store fluids such as paint for long periods of time. Furthermore, the sub-containers have large openings at their center, and therefore do not substantially fill the bucket outer receptacle. Finally, the Axhamre reference does not teach any of the related improvements such as the tray, funnel, or other elements disclosed in the present invention.

Schley, U.S. Pat. No. 4,194,619 teaches a fluid storage container that includes several rigid containers that fit within an outer container. The containers do not stack or nest, however, within the outer container.

The above-described references are hereby incorporated by reference in full.

The prior art teaches various container systems that include outer receptacles such as a bucket, used in conjunction with sub-containers stored within the receptacle. However, the prior art does not teach a container system that includes the structures and benefits as described in the following summary of the invention.

SUMMARY OF THE INVENTION

The present invention teaches certain benefits in construction and use which give rise to the objectives described below.

The present invention provides a storage system for storing a plurality of fluids or other goods. The storage system comprises a receptacle, and a plurality of containers that both stack/nest and tessellate within the receptacle to fill substantially all of the receptacle.

A primary objective of the present invention is to provide a storage system having advantages not taught by the prior art.

Another objective is to provide a storage system that may include larger containers as well as smaller containers that stack upon or nest with each other so that the combined height of the smaller containers is approximately equal to the height of the larger container. Alternatively, the stacked containers may be stacked with multiple sizes and in any combination, including the same size container stacked upon each other to the height less than the receptacle.

Another objective is to provide a storage system wherein the containers within the receptacle securely abut each other and the receptacle inner surface, and substantially fill the volume of the receptacle, thereby maximizing the storage capacity of the system, and also providing for secure storage of the fluids or other goods within the receptacle with minimal shifting and instability.

Another objective is to provide a storage system that includes containers having a suitable handle that makes grasping, removing, and otherwise holding and/or manipulating the containers easier and more efficient.

Another objective is to provide a storage system with the containers being pre-filled with a variety of products or goods, either before or at the time of purchase.

A further objective is to provide a storage system that may include a tray for covering the containers, for additional storage, and for providing a suitable container for pouring and mixing paint or other products, and for also providing additional elements, such as a funnel and/or a pour spout that may be stored in the tray, that further enhance the utility of the invention.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above-described drawing figures illustrate the invention, a storage system 10 for storing a plurality of fluids or other goods, materials, or products. The storage system 10 includes a plurality of containers 30 adapted to fit within a receptacle 12.

Figure 1:
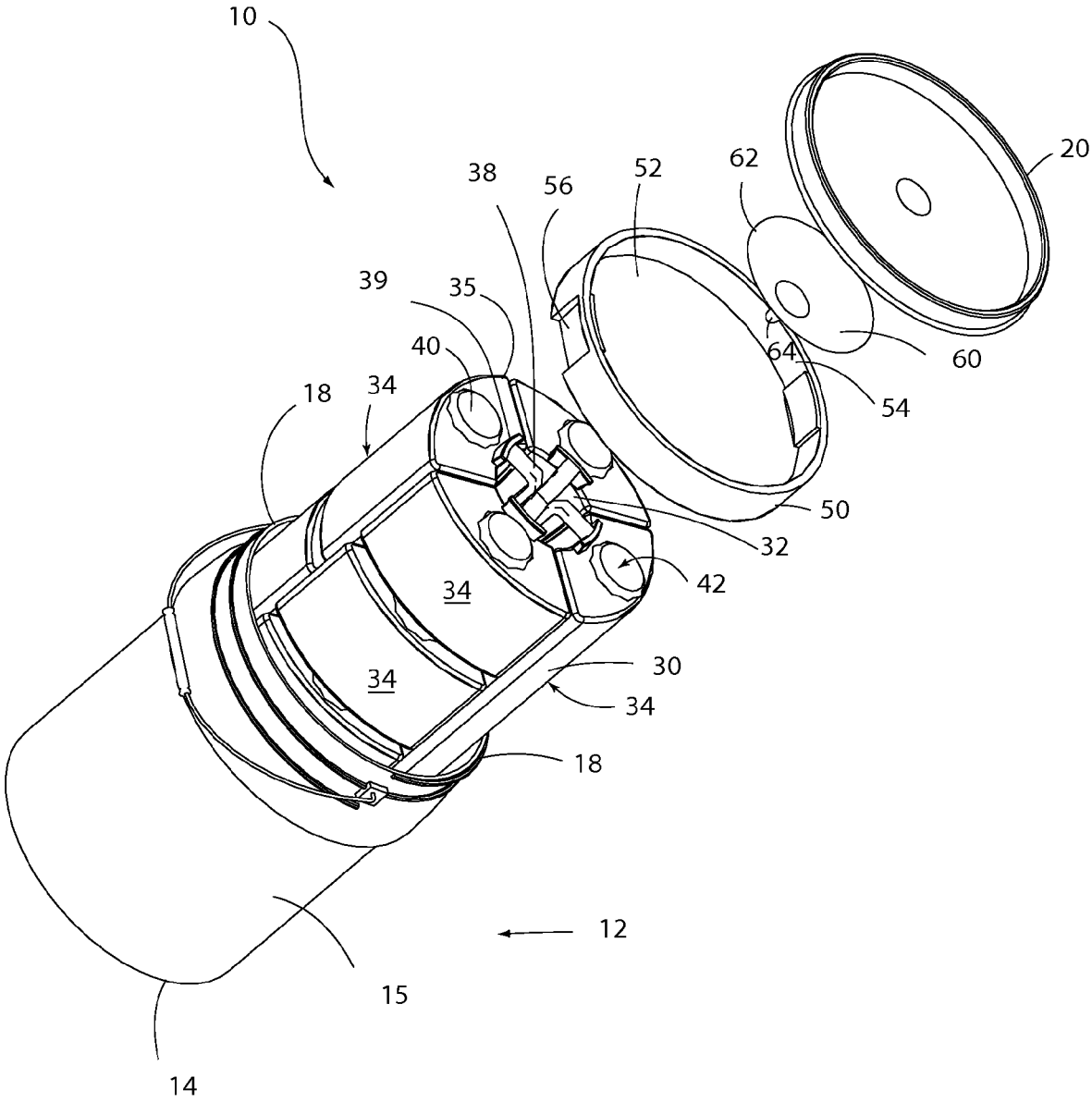
FIG. 1 shows an exploded perspective view of a first embodiment of a storage system for storing a plurality of fluids or other goods, the storage system including a receptacle and removable containers.
Figure 2:
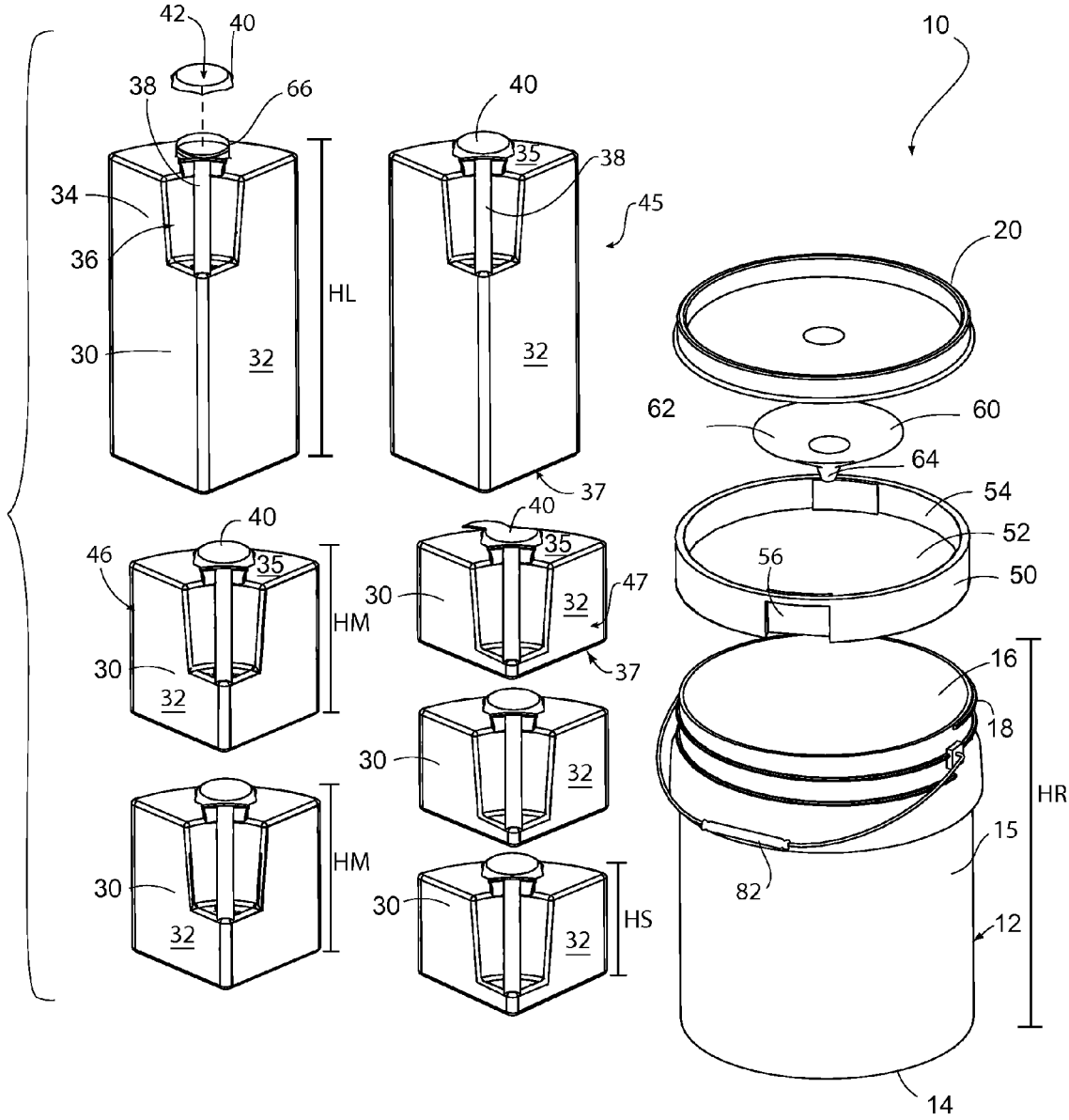
FIG. 2 is a perspective view thereof, illustrating the containers once they have been removed from the receptacle.

FIG. 1 is an exploded perspective view of a first embodiment of the storage system 10, illustrating the receptacle 12 of the system 10, and the plurality of removable containers 30 partially withdrawn from the receptacle 12. FIG. 2 is a perspective view thereof illustrating the containers 30 once they have been completely removed from the receptacle 12. While the receptacle 12 is illustrated, the plurality of containers 30 may be sold separately without the receptacle 12, and the plurality of containers 30 may be inserted into a suitably sized container, such as a commercially available bucket.

As illustrated in FIGS. 1 and 2, the receptacle 12 has a base 14 adapted for supporting the receptacle 12 in an upright position, and an upwardly extending receptacle sidewall 15 extending upwardly from the base 14 to a receptacle perimeter 18 that forms an opening for inserting the containers 30. The upwardly extending receptacle sidewall 15 has an inner surface 16 adapted to receive the plurality of removable containers 30. The receptacle 12 may be constructed of any material, preferably plastic, although any form of metal or other suitable material may also be used. In the present embodiment, the receptacle 12 is an ordinary paint bucket. While the opening formed by the receptacle perimeter 18 is shown on the top of the receptacle 12, it may also be on the side or the bottom of the receptacle 12.

The containers 30 each have an inner sidewall 32, an outer sidewall 34, and a top surface 35 adapted to, together, contain one of the plurality of fluids or other goods. The containers 30 are shaped such that they are stackable and/or nestable ("stack/nest") within the receptacle 12 such that the inner sidewalls 32 of the containers 30 abut each other, and the outer sidewalls 34 abut the inner surface 16 of the receptacle 12, completely filling substantially all of the receptacle 12. For purposes of this application, the term "completely filling" means to fill the available space, as with a tessellation, but allowing for ordinary spacing that is reasonable for such containers, not requiring an airtight, high tolerance fit.

In another embodiment, the containers are created so any combination of containers sizes may be stacked upon each other to achieve an approximately equal stack height less than the height of the receptacle and substantially fills the receptacle.

In one example, the small and large containers 47 and 45 are adapted to either stack upon or nest into each other to equal the height of two medium containers 46 or other combination of containers available.

In a second example, the small, medium, and large containers 47, 46, and 45 are adapted to either stack upon or nest into each other to equal the height of five small containers 47 or other combination of containers available.

In a third example, multiple small 47 and medium 46 containers may be stacked or nested into each other to a stack height less than the height of the receptacle and substantially fill the receptacle.

In a fourth example, each stack could have the same number and sizes of containers such as one large 45 and one small 47 or one medium 46 and two small 47.

In a fifth example, each stack is comprised of two or more containers of the same size.

The top surface 35 includes a spout 66 sealable with a cap 40 such that the storage container 30 is adapted to enclose and seal one of the plurality of fluids or other goods or products within the storage container 30 when the cap 40 is engaged with the spout 66. The storage container 30 may form an air/fluid tight seal to prevent the fluid or other goods from escaping the container 30, and also to prevent the fluid or other goods from drying out or exposure to air. The cap 40 may threadedly engage the spout 66, snap fit onto the spout 66, or otherwise engage the spout 66 to form an air/fluid tight seal. The spout 66 is preferably large enough to receive a brush, scoop, or other item to be inserted into the container 30 for removing the fluid or other material. The inner wall of spout 66 may also be used for removing excess material off items inserted into the container 30. The inner wall of spout 66 may also include an integral pour spout (not shown) for facilitating pouring of the material from the container 30. In an alternative embodiment, the spout may extend from the bottom side of the container, like a tea pot (not illustrated), or may be positioned so that gravity will drain the container when the cap is removed (not illustrated) or when a valve (not shown) is opened.

The cap 40 may also include a flip-up dispenser (not shown) that can be flipped up to enable the fluid or other goods to be dispensed through the cap 40.

As shown in FIGS. 1 and 2, each of the containers 30 is preferably adapted so that there is a recessed portion 36 which forms a handle 38 for grasping the container 30. The recessed portion 36 is preferably formed in the inner sidewall 32 such that a portion of the inner sidewall 32 forms the handle 38 for grasping the container 30. The handle 38 most preferably further includes a ridge 39 extending upwardly for, in concert with the cap 40, supporting another container 30 on top of the container 30 (or for supporting the tray 50). The ridge 39 is preferably co-planar with the planar top surface 42 of the cap 40.

While one embodiment is illustrated in FIGS. 1 and 2, other embodiments of a container handle may also be developed by those skilled in the art, and such alternative embodiments should also be considered within the scope of the present invention. In one alternative embodiment, discussed below, the handle may be formed in the cap 40, which is easily graspable by the user while the containers 30 are within the receptacle 12. In alternative embodiments not shown, the handle may be formed in alternative ways, including alternative shapes, attachment points, etc.

The containers 30 may be standard sized units of about 1 gallon, half gallon, quart, and potentially even pint (or standard metric units), although the invention is not restricted to any particular units, particular sizes of containers or the number of sizes of the containers. As is known in the art, measurement markings (not illustrated) may be marked on the side of each of the containers 30.

The containers 30 are preferably constructed with a material such as plastic, although any suitable material may be utilized. In some embodiments, the containers 30 are preferably constructed of a material that is UV protected and/or FDA approved. The containers 30 may each include a flexible liner (not shown), or other ancillary features, and such alternatives should be considered within the scope of the present invention. The containers 30 may also have an external surface that is smooth, textured, or having a surface design. In another embodiment, the containers 30 may be constructed with a flexible and pliable wall.

The storage system 10 may further include a receptacle lid 20 that is adapted to engage the receptacle perimeter 18 for closing the receptacle 12 and holding the containers 30 inside. As shown in FIG. 1, a tray 50 may be adapted to fit between the plurality of containers 30 and the lid 20 within the receptacle 12. The tray 50 can be adapted to include a bottom surface 52 extending to an upwardly extending tray sidewall 54. The tray 50 not only functions to cover the containers 30, it may also function for containing one of the fluids or other goods from one of the containers 30, to assist with painting or to store other items. The tray sidewall 54 preferably fits within and abuts the perimeter 18 of the receptacle 12, and may include a handle (not shown) and/or finger recesses 56 for facilitating the user grasping the tray 50 by inserting his or her finger between the tray sidewall 54 and the perimeter 18. For purposes of this application, the term finger recess 56 is defined to include handles and similar structures. The tray 50 most preferably abuts both the receptacle lid 20 and the containers 30, thereby securely holding the containers 30 in place and preventing shifting and movement between the containers 30 if, for example, the system 10 were accidentally upended.

As shown in FIGS. 1 and 2, the storage system 10 may also include additional elements to facilitate use of the fluids or other goods stored in the containers 30. For example, the system 10 may include a device that may act as a funnel and/or a spout. The funnel 60 has a wide upper perimeter 62 tapering to a smaller aperture 64. The smaller aperture 64 of the funnel is adapted to fit within the spout 66 of one of the containers 30, for facilitating pouring the fluid or other goods into or out of the container 30. The funnel 60 is preferably sized and shaped to fit within the tray 50.

In the currently preferred embodiment, the fluids or other goods are preferably different colors or types of paints, and/or associated fluids, such as turpentine. For example, the storage system 10 may also be used for storing extra paint. When a home is painted, it is useful to have extra paint of each type used in the house. Once the home is painted, the extra paint can be poured into the containers 12 using the funnel 60, and stored in one place for future use.

The storage system 10 may also be used to package a paint kit for a specific project, such as repainting a room. In this embodiment, the system 10 may include two larger containers 45 of white paint for painting a house, a room, a piece of furniture, or other item. The larger containers 45 have a larger height HL that is approximately equal to a receptacle height HR of the receptacle 12, only preferably slightly smaller so that the larger containers 45 fit within the receptacle 12. The system 10 also includes smaller containers, in this embodiment two medium containers 46 (having a medium height HM) and three small containers 47 (having a smaller height HS). The smaller containers 46 and the medium containers 47 are stackable or nestable, so that the sum of the heights HM or HS of the smaller containers 46 or medium containers 47 are equal to the larger height HL of the larger container 25.

The small and medium containers 47 and 46 are adapted to either stack upon or nest into each other to the larger height HL equal to the larger container 45, thereby enabling the containers 45, 46, and 47, to form a single solid unit that fits securely within the receptacle 12. The two larger containers 45 and the stacks of the small and medium containers 47 and 46 all tessellate, side by side and abutting each other within the receptacle 12, completely filling substantially all of the receptacle 12 (as illustrated in FIG. 1).

In one embodiment, the two medium containers 46 may include a bright blue trim, and three small containers 47 may include assorted other fluids. For example, one of the small containers 47 may have a bright yellow trim that is intended to compliment the blue and white. The containers 45, 46, and 47, may initially be sold with an un-tinted paint that may be tinted at a later time, so that the user may select any combination of colors. Yet another of the small containers 47 might alternatively contain turpentine, and the third small container 47 might include another fluid useful for painting. In alternative embodiments, however, the fluids may be any other fluids or products that a user may want to store, preferably fluids that are stored together such that the fluids are associated with each other.

While one embodiment of the containers 30 is illustrated herein, it should be understood by those skilled in the art that the invention also includes alternative embodiments. In alternative embodiments, the containers may vary tremendously in size, shape, and configuration. For example, the containers may be much smaller when adapted for use with storing fluids that are stored in very small quantities, and they may be much larger in cases where the fluids are stored in very large quantities. The containers may also be adapted to fit within a commercial paint mixer or the contents of the container can be mixed within the container itself. Furthermore, while storing fluids is preferred, the containers may be adapted to store food, dry goods, and any other materials and/or items. For purposes of this application, the term fluid is hereby defined to include such alternative materials and/or items.

In one embodiment, the containers 30 may include a textured or smooth area (not illustrated) that is adapted to be written upon, or a shaped area (not illustrated) for receiving a label. This feature is useful for assisting a user in labeling a container 30.

Figure 3:
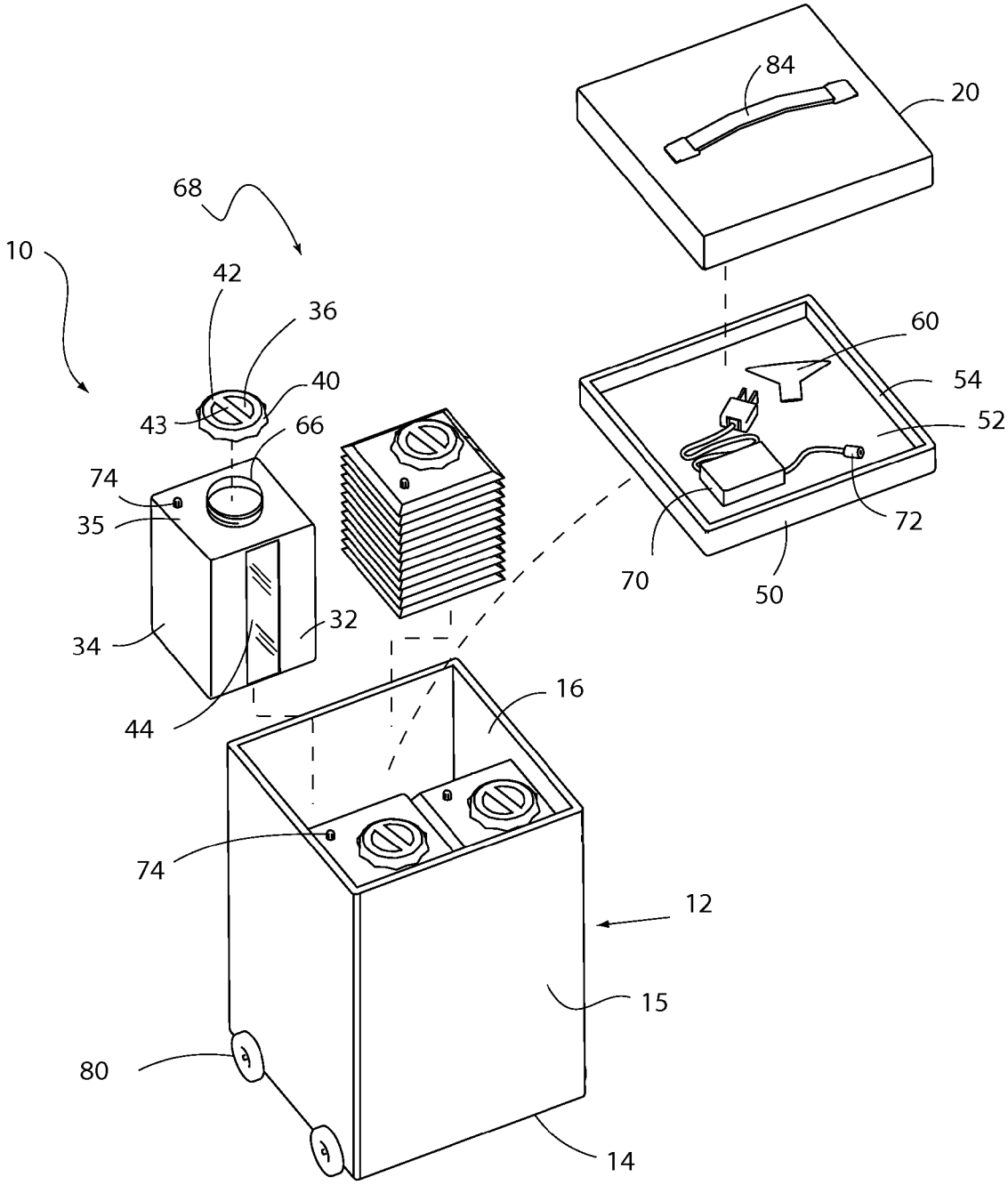
FIG. 3 is an exploded perspective view of an alternative embodiment of the storage system.

FIG. 3 is an exploded perspective view of an alternative embodiment of the storage system, referenced as number 68. As illustrated in FIG. 3, the receptacle 12 and the containers 30 are not restricted to the particular shapes illustrated above, but may include a variety of shapes, including but not limited to the square shapes illustrated. In the embodiment of FIG. 3, the inner and outer sidewalls 32 and 34 may vary depending upon the orientation of the container 30, as long as the operative spacing remains consistent and the containers 30 substantially fill the receptacle 12. While the opening formed by the receptacle perimeter 18 is shown on the top of the receptacle 12, it may also be on the side or the bottom of the receptacle 12.

In the embodiment of FIG. 3, the system 68 includes a pump 70 for removing air from the containers 30, or for pumping an inert gas into the container 30. The pump preferably includes a connector 72 adapted to operably engage a valve 74 of each of the plurality of containers 30 for pumping air from (or other gas into) the container 30. The pump 70 may be a standard pump attachable to the container 30, or it may be integrated into the cap 40 or the container 30 for moving air through a valve (not shown), or by expanding to reduce the pressure within the container 30. Removing the air from the container 30 functions to preserve the fluid or other goods for longer storage periods. The funnel 60 and the pump 70 may both be stored in the tray 50 while not in use.

In an alternative embodiment, not illustrated, the pump may also be integrated into the cap or the container, either a one-way valve that can be used to pump or squeeze air out of the container, or a portion of the cap or container that pops up/down to create/release a partial vacuum.

In this embodiment, the system 68 preferably includes a plurality of wheels 80 operably attached to the receptacle 12 for supporting the receptacle 12 for rotary motion. While wheels 80 are not typically included in paint buckets used in the prior art, they are useful in assisting users with moving the system 68 when they are heavy with a fluid such as paint. While one particular embodiment of the wheels 80 is illustrated, those skilled in the art will recognize that a wide variety of wheels, with different sizes, numbers, and configurations, may be used, and such alternatives should be considered within the scope of the present invention.

As shown in FIG. 3, the cap 40 of each of the containers 30 may include a cap recess 41 which forms a cap handle 43 for lifting the container 30 by the cap 40. Such a handle 43 may be provided instead of, or in conjunction with, the handles 38 illustrated in FIGS. 1 and 2, or in conjunction with any other form of handle that may be provided on or in association with the containers 30. For example, the container 30 may have, in one alternative embodiment, a tip up handle (not illustrated) that folds outwardly from the container 30 for providing a handle for grasping the container 30. Those skilled in the art may develop alternative handles, and such alternative handles should be considered within the scope of the present invention.

In the alternative embodiment, at least one of the plurality of containers 30 may include inner and outer sidewalls 32 and 34 that are collapsible such that the top sidewall 35 and a bottom sidewall 37 of the container 30 can be collapsed towards each other, thereby adjusting the volume of the container 30. The top sidewall 35 and the bottom sidewall 37 may also be made similarly collapsible.

The containers 30 may be constructed of a transparent plastic, or from any other suitable material. If the container 30 is constructed of a non-transparent material, it may include a transparent portion 44 enabling visual observation and measurement of the amount or type of the fluid remaining within the container 30.

The system 10 may also include a receptacle handle 82 pivotally mounted on the receptacle 12, as illustrated in FIG. 1, or a lid handle 84 attached to the lid 20, as illustrated in FIG. 3, to facilitate movement of the receptacle 12.

The terminology used in the present application includes not only the specific words utilized, but also includes similar or equivalent words, and derivatives thereof. Additionally, the words "a," "an," and "one" are defined to include one or more of the referenced item unless specifically stated otherwise. Also, the terms "have," "include," "contain," and similar terms are defined to mean "comprising" unless specifically stated otherwise.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A storage system for storing a plurality of fluids or other goods in a receptacle, the receptacle having a base adapted for supporting the receptacle in an upright position, and an upwardly extending receptacle sidewall extending upwardly from the base to a receptacle perimeter, the upwardly extending receptacle sidewall having an inner surface, the storage system comprising:

a plurality of containers, each of the plurality of containers having an inner sidewall, an outer sidewall, a bottom sidewall, and a top sidewall having a spout sealable with a cap such that the container encloses and seals one of the plurality of fluids or other goods within the container when the cap is engaged with the spout;

wherein the plurality of containers are shaped such that when the containers are positioned within the receptacle, the inner sidewalls of the containers abut each other, and the outer sidewalls abut the inner surface of the receptacle, and such that the plurality of containers together fill substantially all of the receptacle; and wherein the plurality of containers have a height smaller than a height of the receptacle, and each of the containers of the plurality of containers have a height such that when all of the containers are stacked upon or nested with each other, with the bottom sidewall of each container that is stacked upon or nested with another container being in direct contact with either the cap or top sidewall of the other container, the plurality of containers have an approximately equal stacked height less than the height of the receptacle.

2. The storage system of claim 1, further comprising a receptacle lid engaging the receptacle perimeter for closing the receptacle.

3. The storage system of claim 1 further comprising the receptacle.

4. The storage system of claim 1, further comprising a funnel having a wide upper perimeter tapering to a smaller aperture, the smaller aperture sized for fitting within the spout of one of the plurality of containers.

5. The storage system of claim 1, further comprising a second separate spout for fitting within the spout of one of the plurality of containers.

6. The storage system of claim 1, wherein the plurality of containers further comprise a handle.

7. The storage system of claim 1, further comprising a recessed portion in each of the plurality of containers which forms a handle for grasping the container, wherein the recessed portion is formed in the inner sidewall such that a portion of the inner sidewall forms the handle for grasping the container.

8. The storage system of claim 1, further comprising a plurality of wheels operably attached to the receptacle for supporting the receptacle for rotary motion.

9. The storage system of claim 1, further comprising a pump for pumping a gas into or from the containers or a valve for controlling fluid or gas into or from the containers.

10. The storage system of claim 1, wherein at least one of the plurality of containers includes inner side walls, outer sidewalls, top surfaces, and bottom surfaces that are collapsible such that the top and bottom surfaces of the container can be collapsed toward each other or the inner side walls and the outer side walls can be collapsed toward each other, thereby adjusting a volume of the container.

11. The storage system of claim 1, in which at least one of the plurality of containers is, transparent enabling visual observation and measurement of the amount or type of the fluid remaining within the container.

12. The storage system of claim 1, further comprising a tray fitting on top of the plurality of containers and within the perimeter of the receptacle.

13. The storage system of claim 12, wherein the tray includes a bottom surface extending to an upwardly extending tray sidewall.

14. The storage system of claim 1, wherein the cap of each of the plurality of containers includes a top surface adapted to enable the stacking or nesting of the containers within the receptacle.

15. The storage system of claim 14, further comprising a recessed portion in each of the caps which forms a cap handle for lifting the container by the cap.

16. A method of storing a plurality of fluids or other goods in a receptacle with a height, comprising the steps of:

a) storing and sealing the fluids or goods in a plurality of containers with a height, the height of the plurality of containers being smaller than the height of the receptacle, each of the plurality of containers having an inner sidewall, an outer sidewall, a bottom sidewall, and a top sidewall having a spout sealable with a cap, wherein the plurality of containers are shaped such that when the containers are positioned within the receptacle, the inner sidewalls of the containers abut each other, and the outer sidewalls abut the inner surface of the receptacle, and such that the plurality of containers together fill substantially all of the receptacle; and b) placing at least two of the plurality of containers in the receptacle;

c) stacking the plurality of containers to an approximately equal height, smaller than the height of the receptacle, with the bottom sidewall of each container that is stacked upon another container being in direct contact with either the cap or top sidewall of the other container, such that the plurality of containers together fill substantially all of the receptacle.

17. The method of claim 16, wherein the plurality of containers comprises a plurality of smaller containers with a smaller height, and at least one larger container with a larger height smaller than the height of the receptacle.

18. The method of claim 16, wherein the plurality of containers are all of the same height.

19. A storage system for storing a plurality of fluids or other goods in a receptacle, the receptacle having a base adapted for supporting the receptacle in an upright position, and an upwardly extending receptacle sidewall extending upwardly from the base to a receptacle perimeter, the upwardly extending receptacle sidewall having an inner surface, the storage system comprising:

a plurality of containers, each of the plurality of containers having an inner sidewall, an outer sidewall, a bottom sidewall, and a top sidewall having a spout sealable with a cap such that the container encloses and seals one of the plurality of fluids or other goods within the container when the cap is engaged with the spout;

wherein the plurality of containers are shaped such that when the containers are positioned within the receptacle, the inner sidewalls of the containers abut each other, and the outer sidewalls abut the inner surface of the receptacle, and such that the plurality of containers together fill substantially all of the receptacle; and wherein the plurality of containers includes at least one container having a height larger than at least one of the other containers and smaller than a height of the receptacle, and wherein the plurality of containers further includes at least one set of smaller containers, each of the containers having a height such that when all of the containers are stacked upon or nested with each other, with the bottom sidewall of each container that is stacked upon or nested with another container being in direct contact with either the cap or top sidewall of the other container, the plurality of containers have an approximately equal stacked height less than the height of the receptacle.

20. The storage system of claim 19, wherein the stacked set of smaller containers has a height approximately equal to the height of the larger container.

* * * * *